US007637393B2

(12) United States Patent
Mineau et al.

(10) Patent No.: US 7,637,393 B2
(45) Date of Patent: Dec. 29, 2009

(54) ACTUATOR CAP FOR A CONTAINER

(75) Inventors: Steven B. Mineau, Racine, WI (US); Thomas R. Stiebel, Chicago, IL (US)

(73) Assignee: S.C. Johnson & Son, Inc., Racine, WI (US)

( * ) Notice: Subject to any disclaimer, the term of this patent is extended or adjusted under 35 U.S.C. 154(b) by 700 days.

(21) Appl. No.: 11/127,492

(22) Filed: May 12, 2005

(65) Prior Publication Data

US 2005/0218163 A1 Oct. 6, 2005

Related U.S. Application Data

(63) Continuation-in-part of application No. 11/007,070, filed on Dec. 8, 2004, now Pat. No. 7,296,713, and a continuation-in-part of application No. 10/941,791, filed on Sep. 15, 2004, now Pat. No. 7,308,992, and a continuation-in-part of application No. 10/810,002, filed on Mar. 26, 2004.

(51) Int. Cl.
*B67D 5/64* (2006.01)
*B65D 83/00* (2006.01)

(52) U.S. Cl. ..... 222/162; 222/402.23; 222/402.1; 222/182

(58) Field of Classification Search ..... 222/162, 222/153.1, 153.11, 505, 321.8, 507, 402.22, 222/402.21, 402.23, 402.25, 402.1, 402.15, 222/182, 183, 174, 402.13, 402.11
See application file for complete search history.

(56) References Cited

U.S. PATENT DOCUMENTS

| | | | | |
|---|---|---|---|---|
| 2,575,124 | A | 11/1951 | Pollitt | 222/162 |
| 2,673,008 | A | 3/1954 | Ryan | 222/162 |
| 2,766,913 | A | 10/1956 | Wilshusen | 222/394 |
| 2,941,700 | A | 6/1960 | Gable | 222/394 |
| 3,127,065 | A | 3/1964 | Stevenson | 222/164 |
| 3,128,916 | A | 4/1964 | Picot | |
| 3,161,196 | A | 12/1964 | Berkow | 128/225 |
| 3,247,655 | A | 4/1966 | Jacob | 56/255 |
| 3,318,492 | A | 5/1967 | Haas | 222/402.11 |

(Continued)

FOREIGN PATENT DOCUMENTS

EP 0641727 A2 8/1994

(Continued)

OTHER PUBLICATIONS

International Search Report and Written Opinion dated Jul. 28, 2005, Appl. No. PCT/US2005/009772.

(Continued)

*Primary Examiner*—Kevin P Shaver
*Assistant Examiner*—Stephanie E Tyler

(57) ABSTRACT

An actuator cap for a container of product includes a base having an outer wall and a substantially immovable pillar and an actuator member to actuate a valve of the container. The actuator member includes an actuator arm and a central engagement member. The actuator arm extends from the central engagement member and includes a contact surface that extends outwardly from the pillar. A flexible web is flexibly coupled to the base of the actuator cap and the actuator member. An actuator cap may also include a guide member disposed adjacent the actuator member that is configured to guide movement of the engagement member.

17 Claims, 10 Drawing Sheets

U.S. PATENT DOCUMENTS

| | | | | |
|---|---|---|---|---|
| 3,351,239 | A | 11/1967 | Flock | |
| 3,404,814 | A | 10/1968 | Wakeman | |
| 3,516,424 | A | 6/1970 | Eagle | 132/148 |
| 3,618,833 | A | 11/1971 | Webster | 222/402.22 |
| 3,648,905 | A | 3/1972 | Kauder | 222/402.21 |
| 3,739,941 | A | 6/1973 | Ostrwosky et al. | |
| 3,759,431 | A | 9/1973 | Vos | 222/402.22 |
| 3,760,988 | A | 9/1973 | Ostrowsky | 222/153 |
| 3,871,557 | A | 3/1975 | Smrt | 222/162 |
| 3,884,398 | A | 5/1975 | McLaughlin | 222/402.13 |
| 3,884,399 | A | 5/1975 | Matern | 222/402.13 |
| 3,888,392 | A | 6/1975 | Van Coney | |
| 3,907,175 | A | 9/1975 | Haas | 222/402.13 |
| 3,915,353 | A | 10/1975 | Haas | 222/402.1 |
| 3,946,911 | A | 3/1976 | Morane et al. | |
| 3,987,942 | A | 10/1976 | Morane et al. | 222/402.15 |
| 4,013,231 | A | 3/1977 | Van Veldhoven | 239/579 |
| 4,077,548 | A | 3/1978 | Beard | 222/321 |
| 4,077,549 | A | 3/1978 | Beard | 222/321 |
| 4,087,027 | A | 5/1978 | Haas | 222/402.13 |
| 4,124,148 | A | 11/1978 | Vieler et al. | 222/321 |
| 4,132,359 | A | 1/1979 | Nozawa | 239/333 |
| 4,138,039 | A | 2/1979 | Micallef | 222/321 |
| 4,170,316 | A | 10/1979 | LaBarbera | |
| 4,186,855 | A | 2/1980 | Edman et al. | 222/321 |
| 4,277,004 | A | 7/1981 | Barlics | 222/402 |
| 4,378,081 | A | 3/1983 | van Lit | |
| 4,826,054 | A | 5/1989 | Frutin | 222/402.11 |
| 4,860,932 | A | 8/1989 | Nagy | 222/402.1 |
| 5,139,180 | A | 8/1992 | Lucas | 222/402.13 |
| 5,279,444 | A | 1/1994 | Williams | 222/1 |
| 5,287,998 | A | 2/1994 | Smrt | 222/402.1 |
| D347,263 | S | 5/1994 | Phillips | D23/231 |
| 5,307,959 | A | 5/1994 | Bedore et al. | 222/174 |
| 5,310,096 | A | 5/1994 | Rogers et al. | 222/402.13 |
| 5,335,832 | A | 8/1994 | De Laforcade | 222/402.13 |
| 5,358,147 | A | 10/1994 | Adams et al. | 222/183 |
| 5,411,184 | A | 5/1995 | Smrt | 222/402.13 |
| 5,503,303 | A | 4/1996 | LaWare et al. | |
| 5,518,148 | A | 5/1996 | Smrt | 222/174 |
| 5,702,036 | A | 12/1997 | Ferrara, Jr. | 222/402.13 |
| 5,743,431 | A | 4/1998 | Brattesani | 222/1 |
| 5,875,926 | A | 3/1999 | Schwartz | 222/79 |
| 5,875,934 | A | 3/1999 | Miller et al. | |
| 5,915,599 | A | 6/1999 | Takahashi | 222/402.13 |
| 5,971,226 | A | 10/1999 | Goncalves | 222/321.6 |
| 5,992,707 | A | 11/1999 | Gaichuk | 222/402.13 |
| 6,003,739 | A | 12/1999 | Bartlett et al. | 222/402.1 |
| 6,004,056 | A | 12/1999 | De Laforcade | 401/190 |
| 6,299,032 | B1 | 10/2001 | Hamilton | 222/402.15 |
| 6,321,742 | B1 | 11/2001 | Schmidt et al. | 126/38 |
| 6,340,103 | B1 | 1/2002 | Scheindel et al. | 222/402.15 |
| 6,386,397 | B2 | 5/2002 | Brotspies et al. | 222/321.6 |
| 6,390,336 | B1 | 5/2002 | Orozco | 222/162 |
| 6,543,653 | B2 | 4/2003 | Lamboux | 222/321.8 |
| 6,551,001 | B2 | 4/2003 | Aberegg et al. | 401/190 |
| D474,403 | S | 5/2003 | Fahy et al. | D9/448 |
| 6,569,387 | B1 | 5/2003 | Furner et al. | |
| 6,588,631 | B2 | 7/2003 | Sanchez | 222/402.13 |
| 6,592,011 | B1 | 7/2003 | Lammel et al. | |
| 2003/0006252 | A1 | 1/2003 | Henry et al. | |
| 2004/0028458 | A1 | 2/2004 | Heathcock et al. | 401/190 |
| 2004/0188473 | A1 | 9/2004 | Groh et al. | 222/402.13 |
| 2004/0222245 | A1 | 11/2004 | Marroncles | 222/402.13 |
| 2005/0211733 | A1* | 9/2005 | Healy et al. | 222/402.1 |

FOREIGN PATENT DOCUMENTS

| | | |
|---|---|---|
| WO | WO 01/26995 | 4/2001 |
| WO | WO03/024836 | 3/2003 |
| WO | WO 03/103760 | 12/2003 |

OTHER PUBLICATIONS

U.S. Appl. No. 10/810,002, Office Action dated Nov. 8, 2006.
U.S. Appl. No. 10/877,162, Office Action dated Nov. 8, 2006.
U.S. Appl. No. 10/941,791, Office Action dated Apr. 6, 2007.
U.S. Appl. No. 10/877,162, Office Action dated Apr. 17, 2007.
U.S. Appl. No. 10/810,002, Office Action dated Apr. 17, 2007.
U.S. Appl. No. 10/810,002, Office Action dated Sep. 13, 2007.
U.S. Appl. No. 11/007,070, Office Action dated Jun. 1, 2007.
U.S. Appl. No. 11/006,930, Office Action dated Jun. 1, 2007.
U.S. Appl. No. 10/810,002, Office Action dated Mar. 21, 2008.
U.S. Appl. No. 10/810,002, Office Action dated Oct. 16, 2008.

* cited by examiner

ACTUATOR CAP FOR A CONTAINER

CROSS REFERENCE TO RELATED APPLICATIONS

This application is a continuation-in-part of U.S. patent application Ser. No. 10/810,002, filed Mar. 26, 2004. This application is also a continuation-in-part of U.S. patent application Ser. No. 10/941,791, filed Sep. 15, 2004, now U.S. Pat. No. 7,308,992. This application is also a continuation-in-part of U.S. patent application Ser. No. 11/007,070, filed Dec. 8, 2004, now U.S. Pat. No. 7,296,713. This application claims priority to all such previous applications, and such applications are hereby incorporated herein by reference in their entireties.

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates generally to actuating apparatus, and more particularly to actuator caps that are placed on containers and used to dispense product from the containers.

2. Description of the Background of the Invention

Various apparatus for dispensing product from a container have been developed. One such apparatus has an actuator fitted to a container and has an axially extending passage therethrough for discharging product. The actuator has a pair of wings that extend transversely from the actuator. The container may be moved axially within a device such that the wings bear against a surface defining a passage, thereby discharging product through the passage.

Another dispensing apparatus has a spray bottle grip used with a nasal spray bottle. The grip is coupled to a reciprocating nozzle of the spray bottle, and two arms extend downwardly along the spray bottle. The arms include finger flanges that provide an ergonomic means of reciprocating the nozzle to dispense product from the spray bottle. Other devices have a disc-shaped actuator attached to a nozzle of a container. A user depresses the actuator with a finger to dispense product from the container.

One particular type of apparatus has a handle extending along a container body. When a user pulls the handle toward the container body, a portion of the handle pushes downwardly upon a nozzle portion of the container to dispense product from the container. Another type of container has a vertically reciprocating tubular pump. A cap is fitted to the container and has an actuator button extending from a sidewall of the cap. Movement of the actuator button in a direction toward the sidewall of the cap is translated into perpendicular reciprocating movement of the pump.

Yet other apparatus has a total release actuator that provides a time delay between activation of an aerosol valve and discharge of product from an aerosol container. The actuator has an upstanding outer wall portion, a base portion terminating in an inwardly extending annular lip adapted to snap over and under the perimeter of a mounting cup of the container to affix the actuator to the aerosol container. A platform with a valve stem receiving portion that attaches to the valve stem is connected to the upstanding wall by a hinge. On a side opposite the hinge of the platform is a locking tab. Extending radially outward from the platform and through a finger recess in the upstanding outer wall portion is an actuator lever. When the actuator lever is depressed the locking tab engages a locking shoulder located in the wall portion to prevent movement of the actuator lever.

Another apparatus for actuating a container has a shoulder cover for an aerosol container. The shoulder cover has a hinge in the direction of action of the shoulder cover fitted with an aerosol container main body and a locking protrusion and a vertical groove capable of separating part of a ring band to the right and left of the hinge on the inner circumference of the ring band. The ring band can be torn off from the shoulder cover by holding the actuator portion. The actuator of the shoulder cover is a spout or button and once the ring band is removed, the actuator can be moved to actuate the container.

Other apparatuses have a container of product disposed at a first end of a rod and having a trigger mechanism at a second end of the rod wherein a user may actuate the container from a distance. Other devices have an actuating rod with a trigger on a first end and a container on a second end. Pulling the trigger moves the actuating rod longitudinally such that the second end of the rod moves a bell crank, which in turn, moves an additional rod that actuates a valve on the container.

Another type of apparatus is a cleaning device having a trigger at a first end of a rod and a mop cleaning head and a container at a second end of the rod. Pulling the trigger moves a pivot link, which in turn actuates a valve of the container, thereby discharging product from the container onto the surface to be cleaned by the mop cleaning head.

Another particular type of container has an air freshener inserted into a shroud. The shroud has a nozzle that is fitted over a valve of the container. The combination of the container and the shroud is placed within a housing. When a user wishes to spray air freshener into ambient air, the user pushes the housing, which in turn pushes the shroud and the valve to dispense the air freshener out of the housing.

In some instances when a user shakes a container while the container is in a housing, for example, to shake up the emulsion before spraying, the momentum of the container can, as the container is shaken from side to side or if the container is shaken axially, can shove the can toward the end of the housing with sufficient force to cause the actuator to activate the valve of the containers. The result is an unexpected and undesirable discharge of can contents.

SUMMARY OF THE INVENTION

An actuator cap in one embodiment of the present invention has a base having an outer wall with a substantially immovable pillar extending therefrom, and an actuator member. The actuator member includes an actuator arm and an engagement member. The actuator arm extends from the engagement member and includes a contact surface that extends outwardly from the pillar. A flexible web flexibly couples the substantially immovable pillar to the actuator member. The flexible web may attach to the actuator member at any location including, for example to the engagement member. The flexible web may be dimensioned so that movement of the actuator member causes substantially axial movement of the engagement member. The flexible web may also be dimensioned such that non-axial movement of the engagement member is insufficient to actuate a valve of a container attached to the actuator cap. The engagement member of the actuator cap is also dimensioned to attach to the valve of the container. The substantially immovable pillar may also be dimensioned to attach to a valve cup rim of the container.

In other embodiments, the actuator member includes a plurality of actuator arms and the base includes a plurality of substantially immovable pillars where the actuator arms are disposed in spaces between the pillars. In some embodiments with a plurality of actuator arms, at least two actuator members are separated by substantially the same arcuate angle. The actuator cap of the present invention may also have one or more flexible webs dimensioned so that when the actuator arms are separated by an arcuate angle of about 180 degrees, movement of two actuator arms causes substantially axial movement of the engagement member relative to an axis of the container; and when the actuator arms are separated by an arcuate angle of less than about 180 degrees, movement of at least three actuator members causes substantially axial movement of the engagement member relative to an axis of the container.

The actuator cap of the present invention may also be configured such that only substantially axial movement of the engagement member is sufficient to actuate the valve of the container when the actuator cap is attached to the container. In one embodiment, when the actuator cap is attached to the container, movement of the contact surface in an axial direction toward the container actuates the valve of the container.

The flexible web of the present invention may also be flexibly coupled to the base of the actuator cap. The actuator cap may also have one or more guide members disposed adjacent the actuator member and configured to guide movement of the engagement member in, for example, a substantially linear and/or axial motion. In one embodiment, the guide member is disposed on the substantially immovable pillar and/or on the engagement member.

Other aspects and advantages of the present invention will become apparent upon consideration of the following detailed description.

DETAILED DESCRIPTION OF THE DRAWINGS

Figure 1:
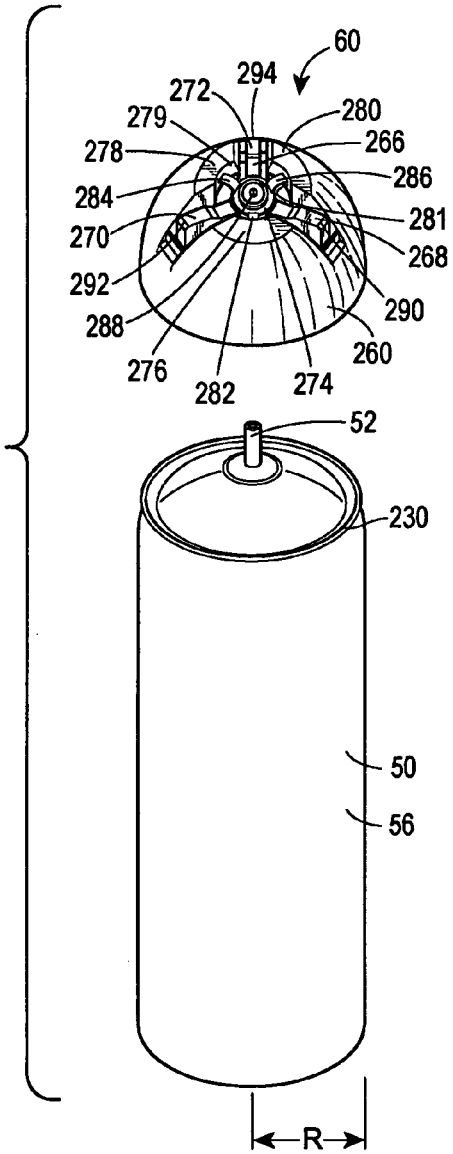
FIG. 1 is an exploded isometric view of a container and actuator cap.

Turning now to the figures, FIG. 1 illustrates a container 50 having a valve 52 and a main body 56 containing product (not shown). The valve 52 may be a male or female valve, and/or a vertically depressible valve or a tilt valve, for example. As will be appreciated hereinafter, if a tilt valve is utilized such valve could also alternatively be depressed vertically without tilting to dispense product therethrough. It should be noted that the valve 52 could be replaced by any suitable apparatus that may be displaced to release product from the container 50. An actuator cap 60 is fitted to the container 50.

Figure 2:
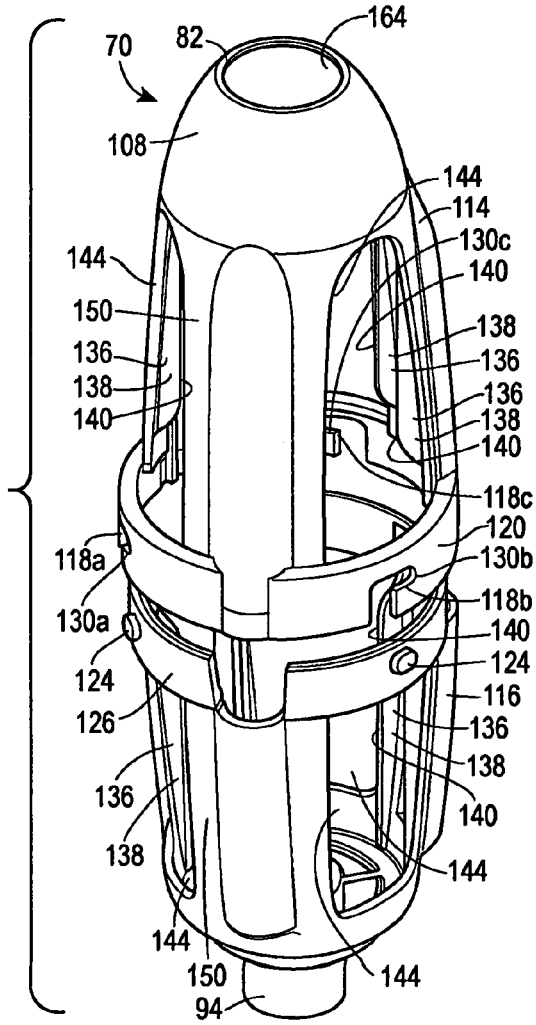
FIG. 2 is an exploded isometric view of a housing into which the container and actuator cap of FIG. 1 may be placed.
Figure 3:
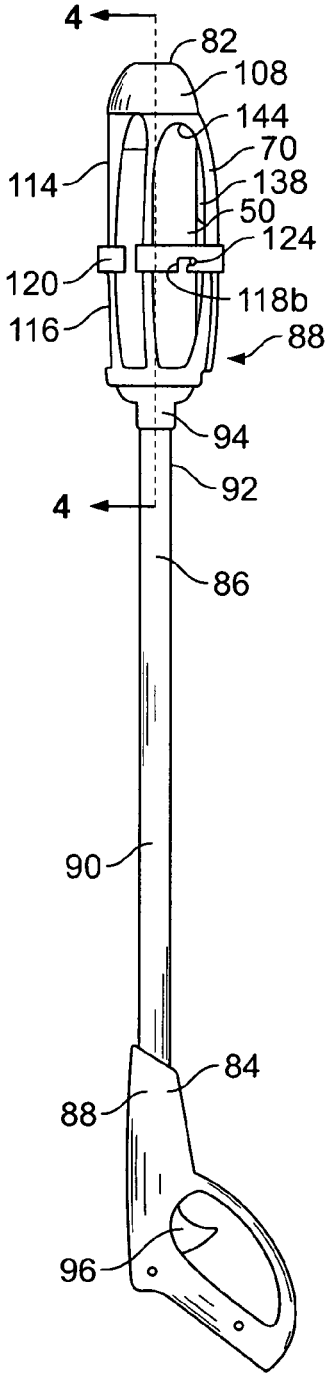
FIG. 3 is a side elevational view showing a rod and trigger mechanism in combination with the housing of FIG. 2.
Figure 4:
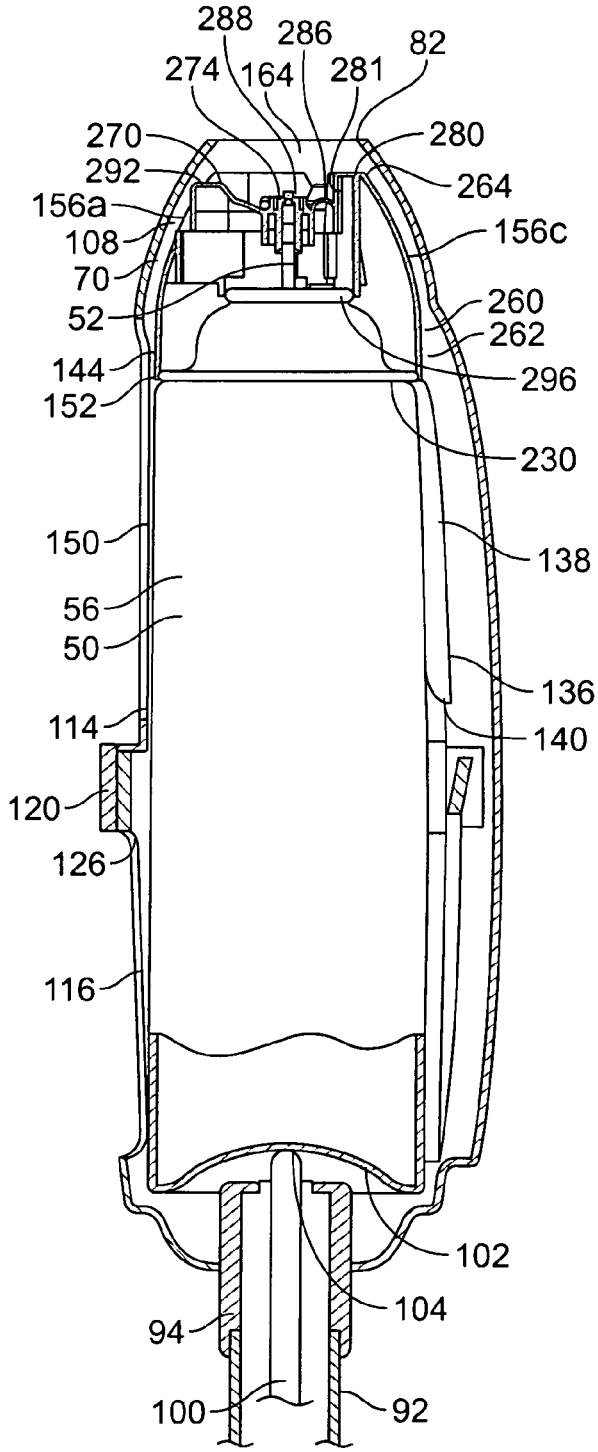
FIG. 4 is a sectional view taken generally along the lines 4-4 of FIG. 3 further illustrating the container of FIG. 1 in elevation and the actuator cap thereof in section.

FIG. 2 illustrates a housing 70 into which the container 50 and the actuator cap 60 may be placed. The container 50 and the actuator cap 60 are a product refill for the housing 70. It should be noted that the product refill may include additional components (not shown) besides the container 50 and the actuator cap 60, such as a sleeve (not shown) disposed around the container 50. The actuator cap 60 has a deflectable actuator member 266 in the form of actuator arms 268, 270, 272 and any suitable engagement member 274 attached to the valve 52. The housing 70 has a discharge opening 82 through which product stored within the container 50 may be dispensed.

Referring to FIGS. 3-6, relatively moving the container 50 and the housing 70 such that the container 50 is moved toward the discharge opening 82 deflects the actuator arms 270, 272, 274, thereby actuating the valve 52 as described herein, causing product to be released from the container 50 and dispensed from the housing 70. A rod and trigger mechanism 84 may be used to move the container 50 within the housing 70. The mechanism 84 includes a hollow tube 86 with a handle assembly 88 at a first end 90 of the tube 86, and a second end 92 of the tube 86 is secured within a sleeve 94 of the housing 70 in any suitable manner such as by welding or appropriately threading the sleeve 94 and the end 92. Pulling a trigger 96 of the handle assembly 88 advances a push rod 100 disposed within the tube 86 against a bottom surface 102 of the container 50, thereby advancing the container 50 toward the discharge opening 82. If necessary or desirable, an end 104 of the push rod 100 may be shaped and/or fitted with a plate or other member to distribute forces more evenly across the bottom surface 102 of the container 50. Further, if desired, rather than moving the container 50 relative to the housing 70 by using the rod and trigger mechanism 84 one could move the container 50 and/or the housing 70 relative to one another by hand to dispense product.

The housing 70 includes a wall 108 that decreases in cross sectional size, tapering to the discharge opening 82. The discharge opening 82 has a cross sectional size greater than a radius R (FIG. 1) of the container 50. Referring again to FIG. 2, the housing 70 may include first and second wall portions 114, 116 that may be joined together to house the container 50 and the actuator cap 60 fitted thereto. The wall portion 114 may include three bayonet slots 118*a*-118*c* disposed on an end 122 of the wall portion 114 and equally spaced from one another by 120 degrees. To join the wall portions 114, 116, a user inserts pins 124 carried by an end 126 of the wall portion 116 into the slots 118*a*-118*c* and provides a relative rotation of the wall portions 114, 116 to seat the pins 124 within recessed regions 130*a*-130*c* of the slots 118.

Either of the wall portions 114, 116 may include protrusions 136 such as guide fins 138 having edges 140 that abut the exterior surface of the container 50 to center the container within the housing 70. Either of the wall portions 114, 116 may include elongate openings or windows 144 that allow a user to see the container 50 when the container is disposed within the housing 70. The housing 70 wall portions 114, 116 may include three windows 144 spaced apart by 120 degrees. The windows 144 may allow a user to see the container 50 including, for example, written directions or graphics disposed on the container (not shown).

Figure 6:
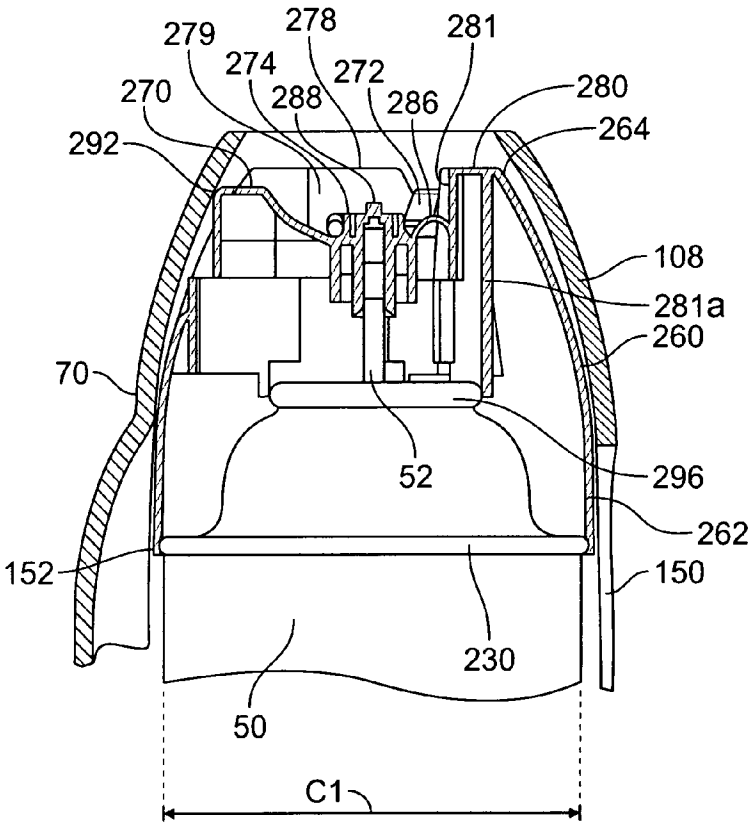
FIG. 6 is a view similar to FIG. 5, but showing the actuator cap of FIG. 1 in an actuating position.
Figure 5:
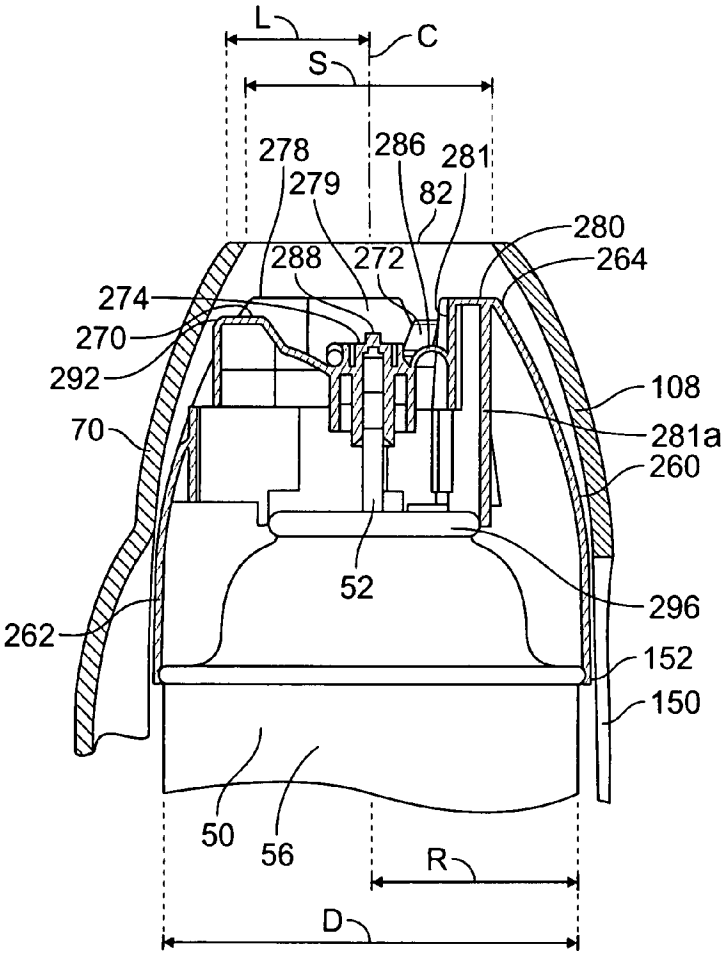
FIG. 5 is an enlarged fragmentary view of FIG. 4.
Figure 8:
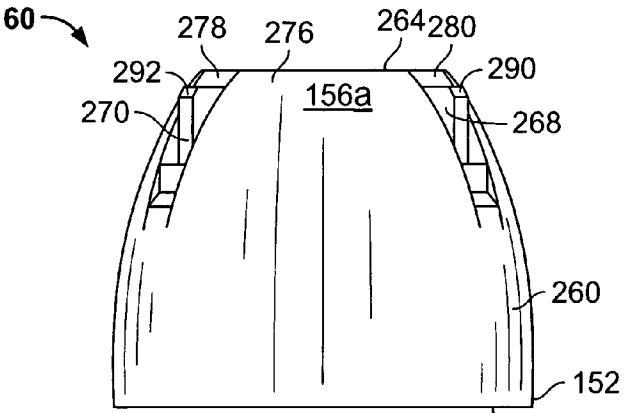
FIG. 8 is a first side elevational view of the actuator cap of FIG. 7.
Figure 10:
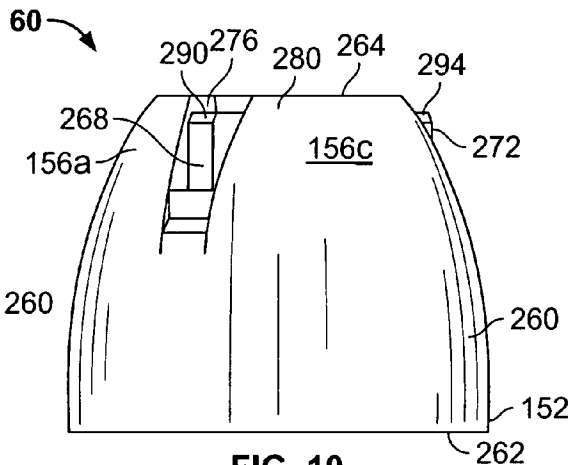
FIG. 10 is a third side elevational view of the actuator cap of FIG. 7.
Figure 7:
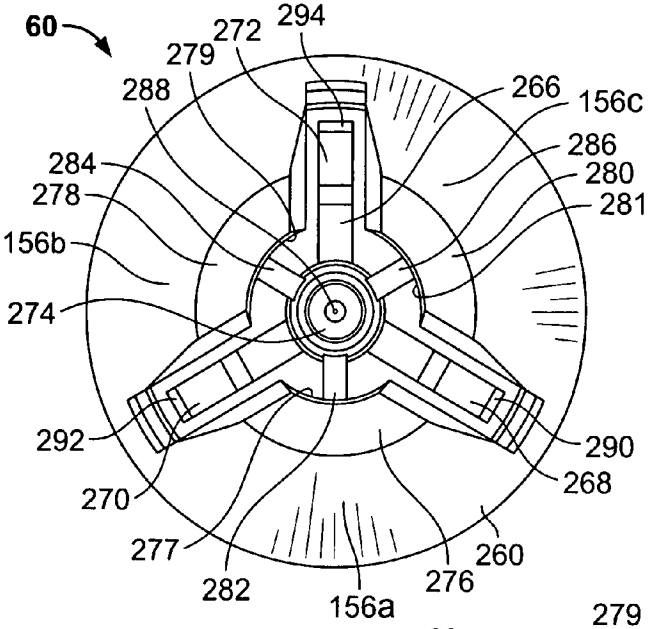
FIG. 7 is a plan view of the actuator cap according to the present invention.
Figure 9:
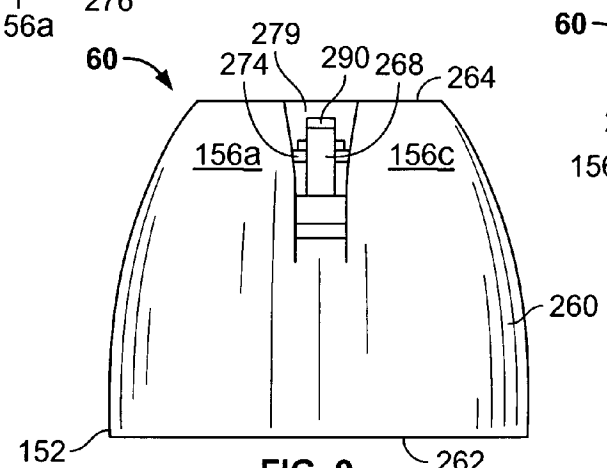
FIG. 9 is a second side elevational view of the actuator cap of FIG. 7.
Figure 11:
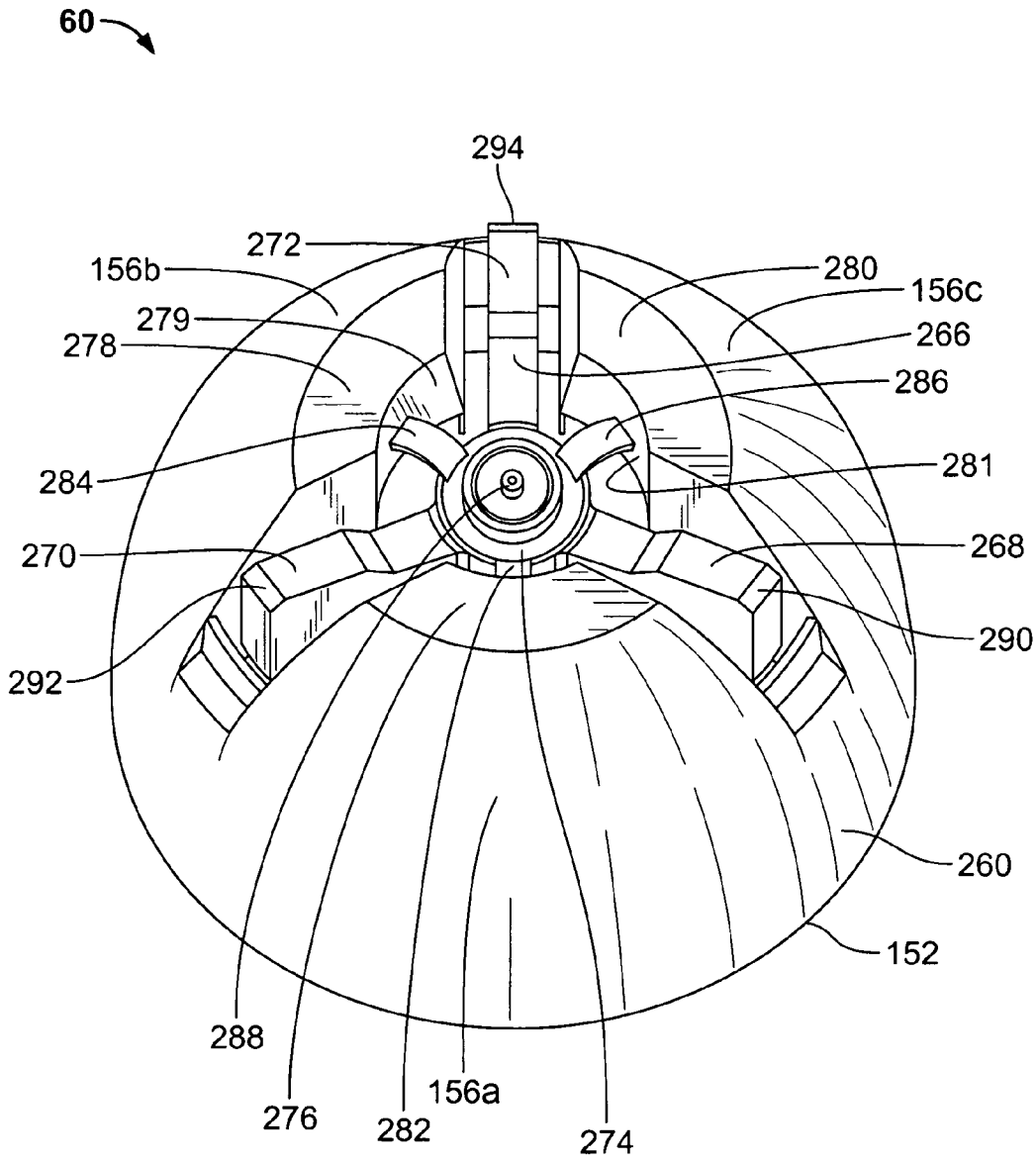
FIG. 11 is an isometric view of the actuator cap of FIG. 7.
Figure 12:
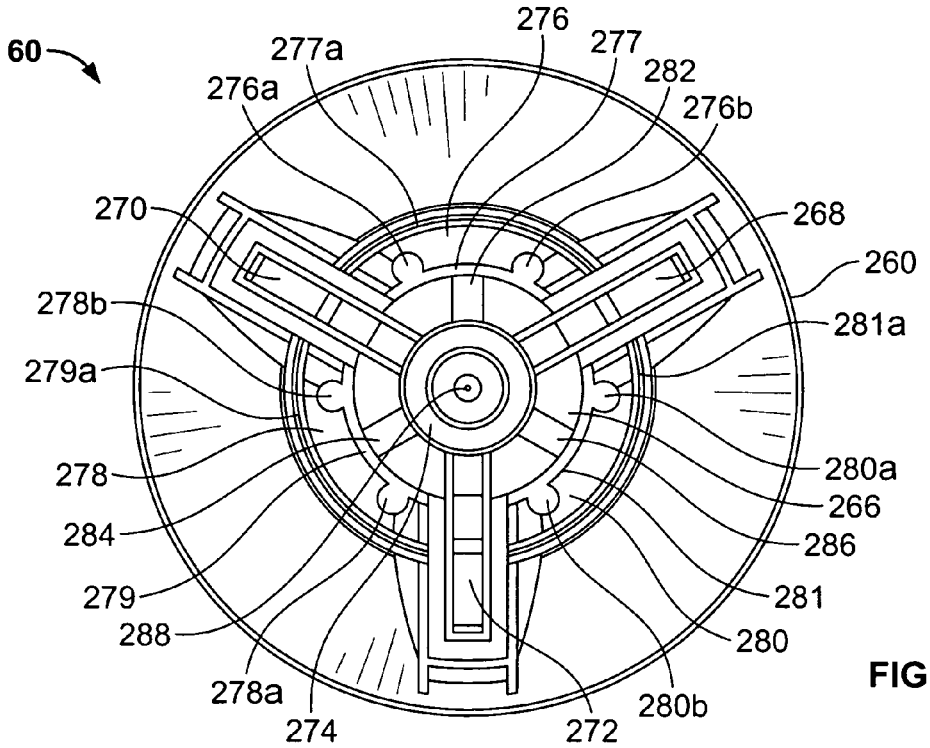
FIG. 12 is a bottom elevational view of the actuator cap of FIG. 7.
Figure 13:
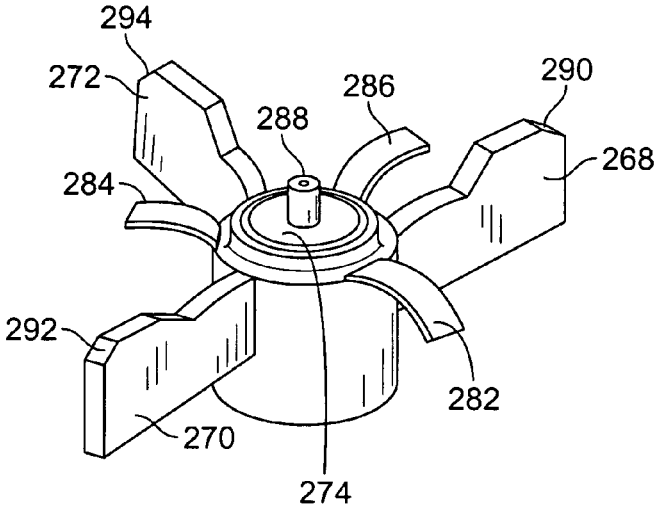
FIG. 13 is an enlarged fragmentary isometric view of an actuator member of the actuator cap of FIG. 7.
Figure 14:
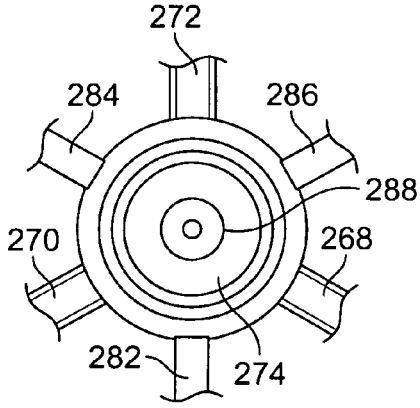
FIG. 14 is a bottom elevational view of the actuator member of FIG. 13.

Referring also now to FIGS. 5 and 6, a main region 150 of the wall portions 114, 116 may have an inner cross sectional size C1 of about 66 mm (2.6 inches), and thus the product refill, comprising the container 50 and the actuator cap 60, may have a cross sectional size of up to about 66 mm. In this regard, while a range of sizes is available for the container 50 one may wish to provide a container sized at or near maximum to provide a maximum useful life for the container 50 given the available space within the housing 70.

Also now referring to FIGS. 7-20, the actuator cap 60 has a base 260 that decreases in cross sectional size along an axial dimension defined between a first end 262 for fitting over the container 50 and a second end 264 for discharging product from the container. The actuator member 266 is disposed in spaces between substantially immovable pillars 276, 278, 280 and includes three actuator arms 268, 270, 272 that are spaced apart by about 120 degrees and extend transversely to an axial dimension of the cap. The actuator arms 268, 270, 272 each include a contact surface 290, 292, 294 and are attached to an engagement member 274. The actuator arms 268, 270, 272 extend from the base 260 and outwardly from respective pillars 276, 278, 280. The immovable pillars 276, 278, 280 each have a side wall 277, 279, 281, an interior side wall 277*a*, 279*a*, 281*a* that is dimensioned to attach to a valve cup rim 296 of the container 50, and support ribs 276*a*, 276*b*, 278*a*, 278*b*, 280*a*, 280*b* that assist in resisting deflection inwardly toward the engagement member 274 or outwardly from the actuator cap 60. The support ribs 276*a*, 276*b*, 278*a*, 278*b*, 280*a*, 280*b* may provide resistance to axial deflection that assist in increasing crush resistance of the actuator cap. The actuator member 266 is flexibly attached to the substantially immovable pillars 276, 278, 280 at the engagement member 274 by three flexible webs 282, 284, 286 that are spaced apart by about 120 degrees. The engagement member 274 is dimensioned to attach to the valve 52 and includes a substantially axially oriented discharge orifice 288. The engagement member 274 is secured to the valve 52 as shown in FIGS. 5 and 6.

The actuator cap 60 provides a useful centering function in that peripheral surfaces 156*a*-156*c* of the pillars 276, 278, 280 maintain the discharge orifice 288 of the actuator cap 60 in a centrally located position relative to the discharge opening 82, thereby minimizing the potential for product impingement against a surface 164 of the tapered wall 108. The surfaces 156*a*-*c* may optionally be tapered. Referring also to FIG. 5, the pillars 276, 278, 280 of the actuator cap 60 have a length L defined between a longitudinal centerline C (FIG. 5) of the actuator cap and a peripheral surface 292 of the pillars 276, 278, 280. The length L is selected relative to the inner dimensions of the tapered wall 108 such that the peripheral surface 292 is disposed in interfering relationship with the tapered wall 108. It should be appreciated that the actuator cap 60 and/or the pillars 276, 278, 280 could have any suitable shape so long as the pillars 276, 278, 280 are dimensioned to have an interference relationship with the tapered wall 108. The length L may have any suitable value such as greater than about one-quarter (25%) a largest diameter of the product refill or greater than or equal to about one-third (33%) the largest diameter of the product refill, whether the largest diameter is defined by the container 50, the actuator cap 60, or some other component of the product refill. The length L may be greater than about one-quarter (25%) of a largest diameter D of the actuator cap 60, measured at the first end 152. The length L may be greater than or equal to about one-third (33%) the largest diameter D. Of course, the length L may be alternatively expressed relative to the size of the container 50. In any event, a largest lateral dimension across the product refill cannot exceed the internal cross sectional size C1 (FIG. 6) of the housing 70, and L may have any suitable value such as greater than about one-quarter (25%) of this largest lateral dimension C1. One could select any suitable cross sectional size S (FIG. 5) for the discharge opening 82, such as a cross sectional size of about 34 mm (1.3 inches), and suitable values of L might range between about 18 mm (0.7 inch) and about 33 mm (1.3 inches) to provide the above-described interfering relationship. For example, a value for L may be about 25 mm (1 inch). It should be noted that while the tapered wall 108 of the housing 70 is illustrated as symmetrical around the longitudinal centerline C of the housing 70, the wall 108 could be made asymmetrical, greater in cross sectional size in one plane rather than another, and the shape of the actuator cap 60 could be made complementary therewith to serve as a keying function to orient the container 50 relative to the housing 70 in a particular angular orientation. This could be advantageous for various reasons, such as where product discharges in an asymmetrical pattern.

A cover (not shown) may also be fitted to the actuator cap 60 to shield the contact surfaces 290, 292, 294 to prevent inadvertent actuation of the valve 52 during shipment.

Now referring to FIG. 6, relatively moving the container 50 and the housing 70 such that the main body 56 of the container 50 and the discharge opening 82 are moved toward each other causes the contact surfaces 290, 292, 294 of the actuator arms 268, 270, 272 to engage the surface 164 of the tapered wall 108, thereby deflecting the actuator arms. During such deflection, the actuator arms 268, 270, 272 and the engagement member 274 move downwardly toward the container 50 flexing the flexible webs 282, 284, 286. The flexible webs 282, 284, 286 may be dimensioned and/or of a stiffness so that movement of the actuator member 266 causes substantially axial movement of the central engagement member 274 relative to an axis of the container 50 when the actuator arms 268, 270, 272 are deflected. For example, a shorter flexible web 282, 284, 286 may require more force than an otherwise similar but longer flexible web before extending to a point that actuates the valve 52 of the container 50. Illustratively, when the actuator arms 268, 270, 272 are separated by an arcuate angle of less than about 180 degrees, the flexible webs 282, 284, 286 are dimensioned such that movement of at least three of the actuator members causes substantially linear movement and/or axial movement, for example, non-tilting movement, of the engagement member 274. In other embodiments where the actuator arms are separated by an arcuate angle of about 180 degrees (not shown), movement of two actuator arms causes substantially linear movement and/or axial movement of the central engagement member 274. Sufficient axial displacement of the engagement member 274 actuates the valve stem 52 such that product contained in the container 50 dispenses from the container through the discharge orifice 288 and out of the housing 70.

The actuator cap 60 disclosed herein may be designed to reduce the likelihood of inadvertent dispensing that might result from a user inadvertently shaking or jostling the housing 70 with the container 50 disposed therein. For example, where the valve 52 of the container 50 is a vertically depressible valve, the flexible webs 282, 284, 286 may be dimensioned such that non-axial movement of the central engagement member is insufficient to actuate the valve stem thereby potentially reducing or minimizing product discharge from the container 50. The pillars 276, 278, 280 of the actuator cap 60 may also be substantially immovable having an inherent resistance to movement provided by the support ribs 276*a*, 276*b*, 278*a*, 278*b*, 280*a*, 280*b*, and the resistance may be increased or decreased as desired for a particular actuator cap design. Where the pillars 276, 278, 280 are rigid, a sufficient amount of external mechanical force must act upon the contact surfaces 290, 292, 294 of the actuator arms 268, 270, 272 to overcome resistance provided by the flexible webs 282, 284, 286. In this regard, the resistance of the flexible webs 282, 284, 286 against movement provides a reactive force against forces directing the container 50 toward the discharge opening 82, such that the reactive force must be overcome before dispensing may occur. This reactive force is advantageous in that low force levels may be insufficient to overcome same to actuate the valve 52 of the container 50 and dispense product from the housing 70. For example, such low force levels may occur from a user jostling the housing 70 while walking or manipulating the housing or may arise as a user shakes the housing to mix the contents of the container 50. Such jostling could cause the actuator cap 60 to be in a condition where one or more of the contact surfaces 290, 292, 294 are slightly deflected and the engagement member 272 is either un-deflected or deflected to a lesser extent than necessary to actuate the valve 52. The reactive force provided by the flexible webs 282, 284, 286 reduces inadvertent dispensing until such time as the user intentionally applies sufficient force, thereby deflecting the contact surfaces 290, 292, 294 and axially deflecting the engagement member 272 to an actuating position thereof. Thus, the user can pull the trigger 96 shown in FIG. 3 to intentionally dispense product, while inadvertent dispensing is reduced, minimized or avoided.

Figure 15:
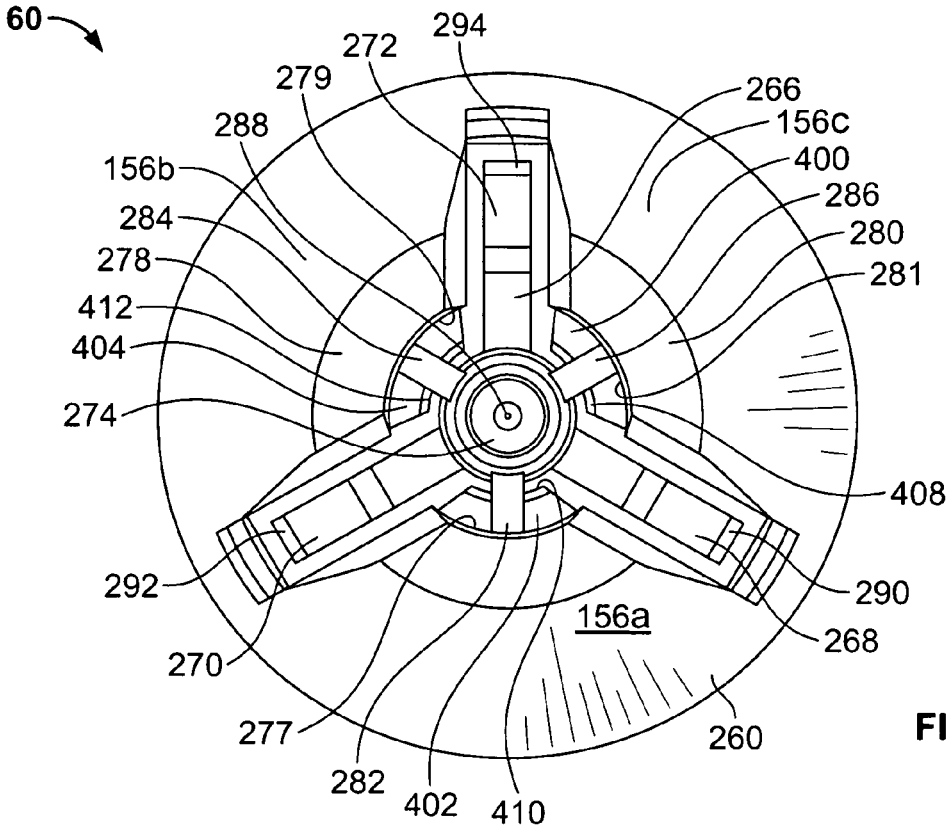
FIG. 15 is a plan view of another actuator cap according to the present invention.
Figure 16:
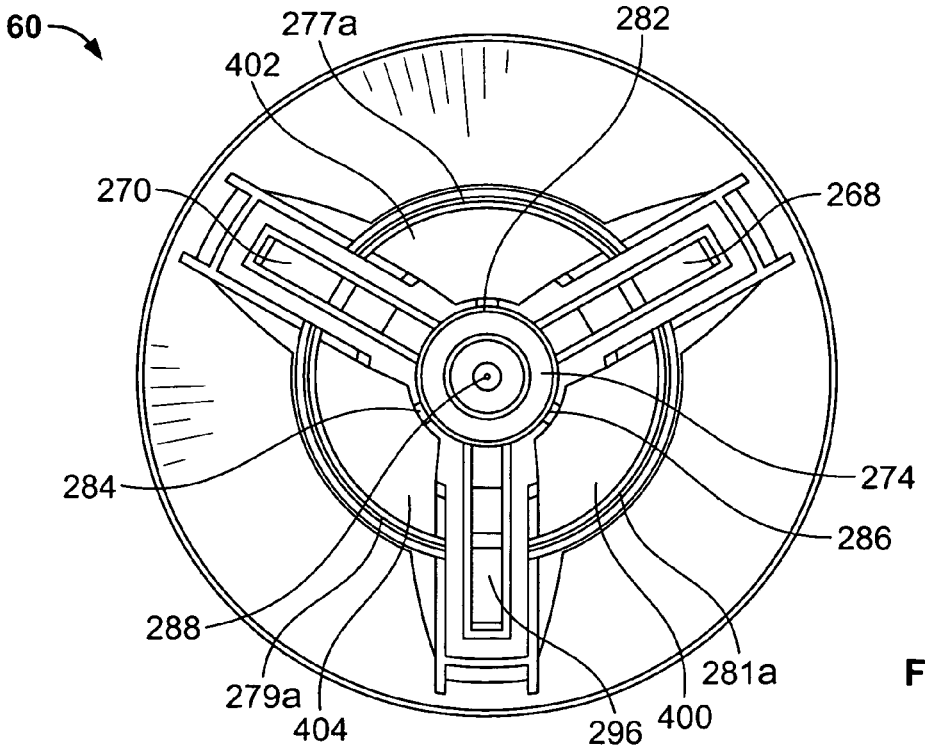
FIG. 16 is a bottom elevational view of the actuator cap of FIG. 15.
Figure 17:
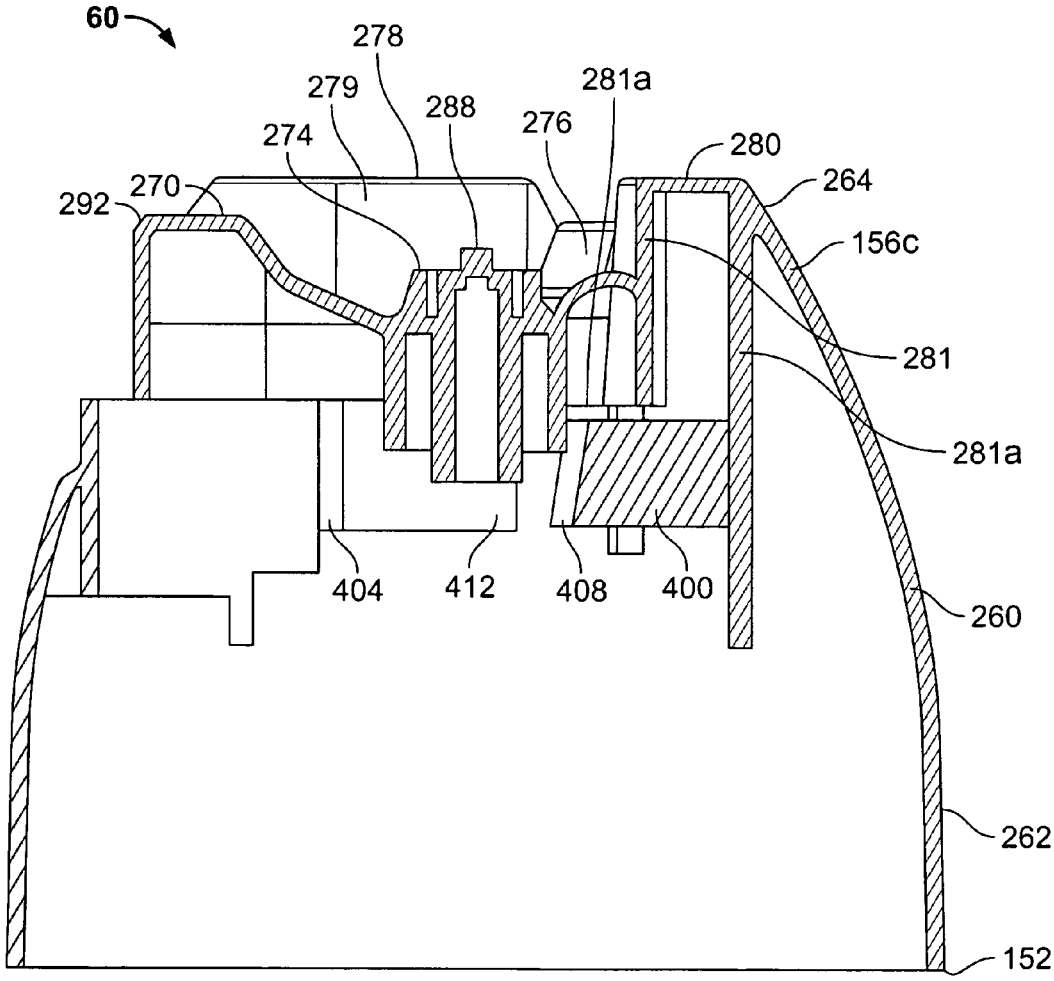
FIG. 17 is a cross-sectional view of the actuator cap of FIG. 15.
Figure 18:
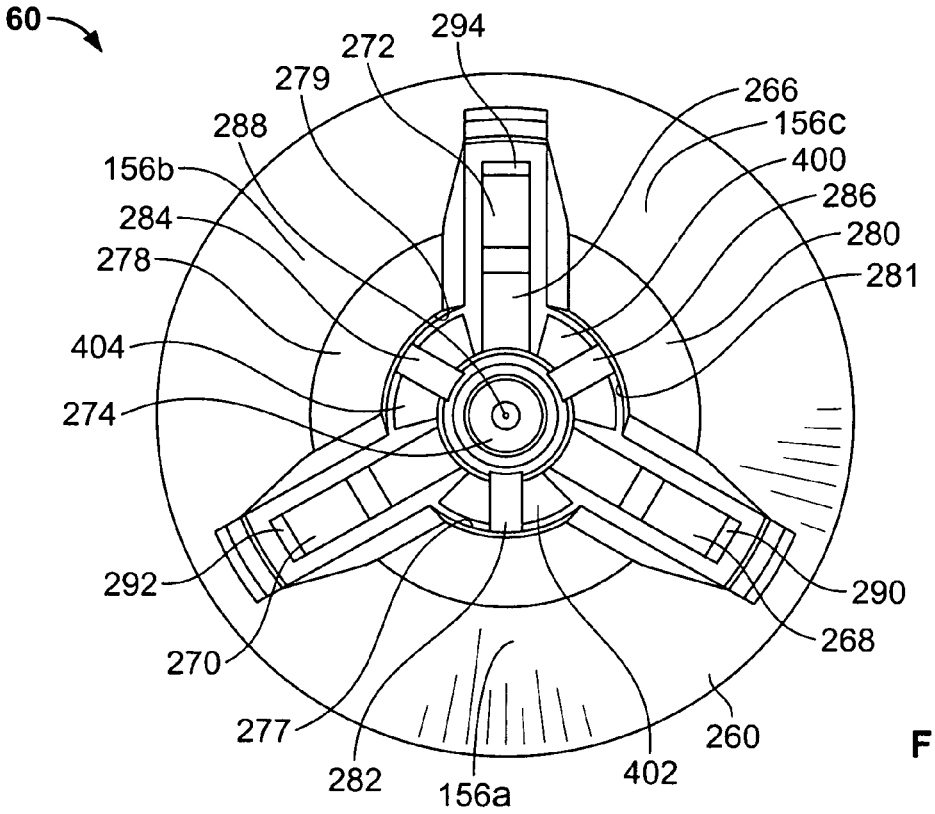
FIG. 18 is a plan view of yet another actuator cap according to the present invention.
Figure 19:
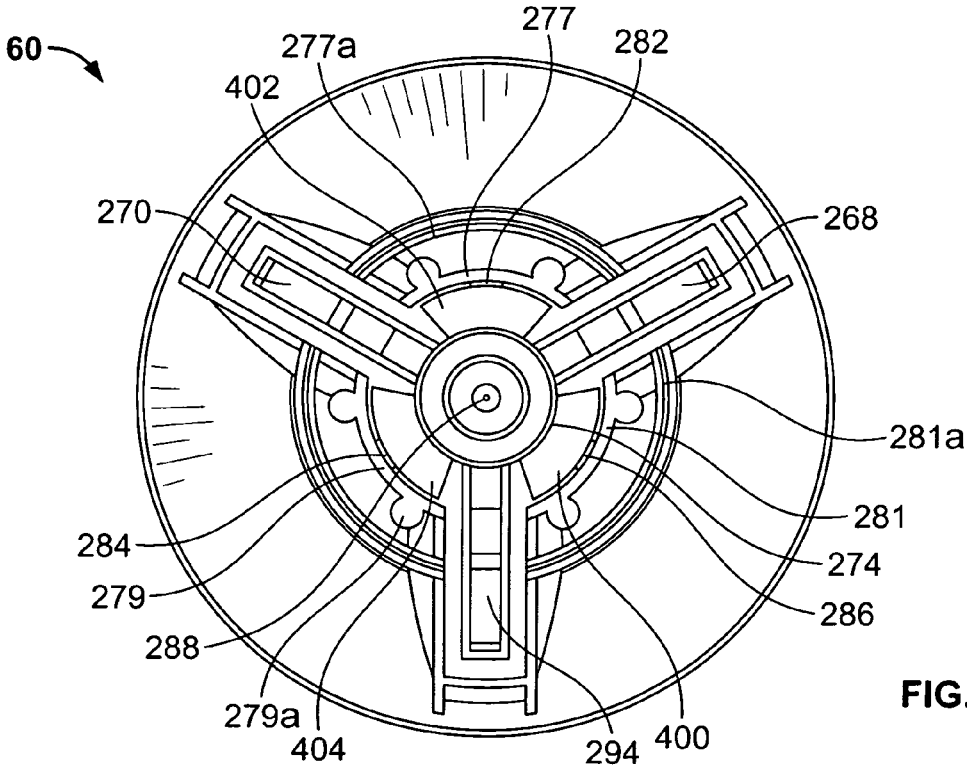
FIG. 19 is a bottom elevational view of the actuator cap of FIG. 18.
Figure 20:
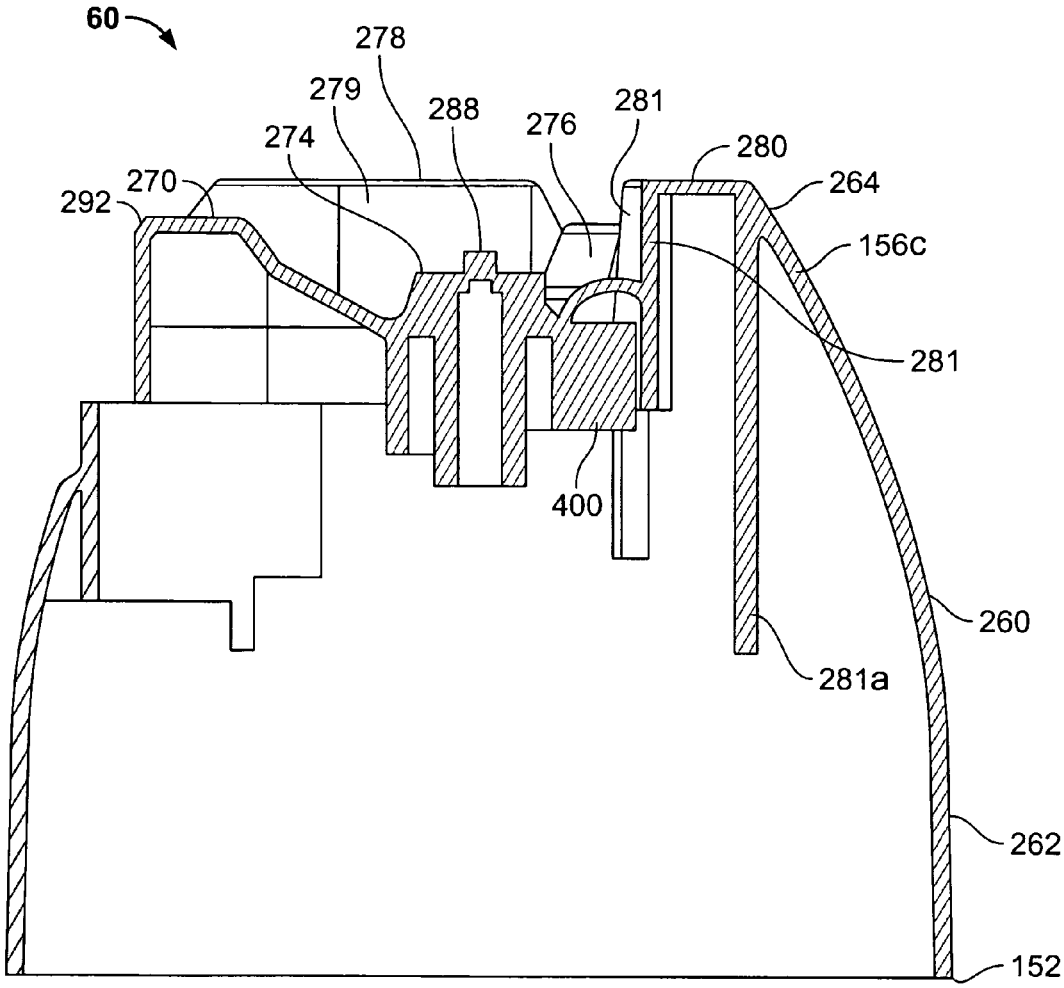
FIG. 20 is a cross-sectional view of the actuator cap of FIG. 18.

In other embodiments of the present invention, and now also referring to FIGS. 15-20, one or more guide members 400, 402, 404 are provided proximate to or disposed on the engagement member 274 to assist in providing linear or axial movement of the engagement member when one or more of the actuator arms 268, 270, 272 are depressed in a direction toward the first end 262 of the actuator cap 60. The guide members 400, 402, 404 can be positioned at any location within the actuator cap 60, and as shown in FIGS. 15-17 the guide members may be disposed on the pillars 276, 278, 280 such as on one or more interior side walls 277*a*, 279*a*, 281*a*, and/or, as shown in FIGS. 18-20, the guide members may be disposed on the engagement member 274. The guide members 400, 402, 404 may also be dimensioned such that depression of any number of actuator arms creates substantially axial movement of the engagement member 274. In FIGS. 15-17 the side walls 408, 410, 412 are tapered from the base first end 262 to the base second end 264 to assist in guiding the engagement member 274 in a substantially linear or axial direction. FIGS. 18-20 illustrate guide members 400, 402, 404 with straight walls 408, 410, 412 that form a cylinder open on three sides around the engagement member to allow the actuator arms 268, 270, 272 to pass through the guide members if necessary to actuate the valve 52 of the container 50.

The guide members 400, 402, 404 as shown in FIGS. 15-20 may work in conjunction with and/or independently of the flexible webs 282, 284, 286 in guiding the movement of the engagement member 274. The guide members 400, 402, 404 may also assist in, for example, reducing the number of flexible webs 282, 284, 286 required to attach the engagement member 274 to the base 260, and/or increasing or decreasing the length, width, and/or thickness of a flexible web, and/or reducing the stiffness of a flexible web, to achieve a desired motion of the engagement member 274. Also, where the valve 52 is a vertically depressible valve, the guide members 400, 402, 404 may be positioned or configured to assist in guiding the engagement member 274 in a substantially linear or axial motion. When the valve 52 is a tilt valve the guide members 400, 402, 404 may be positioned or configured to assist in guiding the engagement member 274 in a direction that actuates the tilt valve, for example, in direction transverse to an axial direction of the tilt valve. The guide members 400, 402, 404 may also be dimensioned, positioned, and/or configured such that only one actuator arm 268, 270, 272 is necessary to create the desired movement of the engagement member 274 independently or in conjunction with the flexible webs 282, 284, 286.

The guide members 400, 402, 404 and/or flexible webs 282, 284, 286 may also assist in distributing unevenly applied downward force applied to one or more actuator arms 268, 270, 272 to the remaining actuator arms. In such cases, the force necessary to depress one actuator arm 268, 270, 272 independently on a multi-arm actuator member 266, may be increased due to the resistance provided by the remaining actuator arms and associated guide members 400, 402, 404 and/or flexible webs 282, 284, 286. This redistribution of force may, for example, reduce or minimize the occurrence of accidental actuation of the valve 52 when fewer than all actuator arms 272, 274, 276 are depressed, such as when, for example, a user is transporting the container 50 and actuator cap in the housing 70.

INDUSTRIAL APPLICABILITY

The foregoing embodiments are useful for dispensing a variety of products such as insecticides, cleaning products, air treatment products (for example, air fresheners), or other products.

The invention has been described in an illustrative manner, and it is to be understood that the terminology used is intended to be in the nature of description rather than of limitation. All patents and other references cited herein are incorporated by reference in their entirety. Many modifications, equivalents, and variations of the present invention are possible in light of the above teachings, therefore, it is to be understood that within the scope of the appended claims, the invention may be practiced other than as specifically described.

We claim:

1. An actuator cap, comprising:

a base having an outer wall and a substantially immovable pillar extending therefrom;

an actuator member including an actuator arm and an engagement member, the actuator arm extending from the engagement member in a direction separated by an arcuate angle of about 180 degrees from the substantially immovable pillar and including a contact surface that extends outwardly beyond the substantially immovable pillar; and a flexible web flexibly coupled to the base and the actuator member.

2. The actuator cap of claim 1, wherein the flexible web is dimensioned so that movement of the actuator member causes substantially axial movement of the engagement member.

3. The actuator cap of claim 1, wherein the flexible web is flexibly coupled to the substantially immovable pillar and the engagement member.

4. The actuator cap of claim 1, wherein the engagement member is dimensioned to attach to a valve of a container

5. The actuator cap of claim 1 ,wherein only substantially axial movement of the engagement member is sufficient to actuate a valve of a container when the actuator cap is attached to the container.

6. The actuator cap of claim 1 wherein the actuator member includes a plurality of actuator arms and the base includes a plurality of substantially immovable pillars, and wherein the actuator arms arc disposed in spaces between the plurality of substantially immovable pillars.

7. The actuator cap of claim 6, wherein at least two actuator members are separated by substantially the same arcuate angle.

8. The actuator cap of claim 6, wherein the flexible web is dimensioned so that when the actuator arms are separated by an arcuate angle of about 180 degrees, movement of two actuator arms causes substantially axial movement of the engagement member; and when the actuator arms are separated by an arcuate angle of less than about 180 degrees, movement of at least three actuator members causes substantially axial movement of the engagement member.

9. The actuator cap of claim 1, wherein the substantially immovable pillar is dimensioned to attach to a valve cup rim of a container.

10. The actuator cap of claim 1, wherein the actuator cap is attached to a container and movement of the contact surface in a direction toward the container actuates a valve of the container.

11. An actuator cap, comprising:

a base having a first plurality of spaced, substantially immovable pillars extending therefrom;

an actuator member including an engagement member and a second plurality of actuator arms disposed in spaces between the first plurality of spaced. substantially immovable pillars, each actuator arm transversely extending outwardly from an axial dimension of the engagement member in a direction separated by an arcuate angle of about 180 degrees from one of the plurality of the substantially immovable pillars and including a contact surface that extends outwardly beyond an outer surface of an adjacent pillar; and a flexible web flexibly coupled to the engagement member and the at least one of the first plurality of spaced. substantially immovable pillars;

whereby the flexible web is dimensioned such that non-axial movement of the engagement member is insufficient to actuate a valve of a container attached to the actuator cap.

12. The actuator cap of claim 11, wherein the engagement member is dimensioned to attach to a valve of a container.

13. The actuator cap of claim 11 where in at least two actuator members are separated by substantially the same arcuate angle.

14. The actuator cap of claim 11, wherein the flexible web is dimensioned so that at least one of when the actuator arms are separated by an arcuate angle of about 180 degrees, movement of two actuator arms causes substantially axial movement of the engagement member; and when the actuator arms are separated by an arcuate angle of less than about 180 degrees, movement of at least three actuator members causes substantially axial movement of the engagement member.

15. The actuator cap or claim 11, wherein each of the first plurality of spaced, substantially immovable pillars is dimensioned to attach to a valve cup rim of a container.

16. The actuator cap of claim 11, wherein the actuator cap is attached to a container and movement of the contact surface in a direction toward the container actuates a valve of the container.

17. An actuator cap, comprising:

a base having a substantially immovable pillar extending therefrom;

an actuator member including an actuator arm and a engagement member, the actuator arm extending from the engagement member and including a contact surface that extends outwardly beyond the substantially immovable pillar;

a flexible web flexibly coupled to the base and the actuator member; and a guide member disposed adjacent the actuator member and configured to axially guide movement of the engagement member, wherein the guide member is disposed on at least one of the substantially immovable pillar or the engagement member.

* * * * *

UNITED STATES PATENT AND TRADEMARK OFFICE

CERTIFICATE OF CORRECTION

PATENT NO. : 7,637,393 B2
APPLICATION NO. : 11/127492
DATED : December 29, 2009
INVENTOR(S) : Mineau et al.

It is certified that error appears in the above-identified patent and that said Letters Patent is hereby corrected as shown below:

Title page, item (*) Notice: Subject to any disclaimer, the term of this patent is extended or adjusted under 35 U.S.C. 154(b) by 700 days.

Delete "700 days" and insert --1266 days--.

Column 9, Line 47: replace "spaced." with --spaced,--

Column 10, Line 7: replace "spaced." with --spaced,--

Signed and Sealed this

Twenty-seventh Day of July, 2010

David J. Kappos

David J. Kappos
*Director of the United States Patent and Trademark Office*